US009598648B2

(12) United States Patent
O'Rear et al.

(10) Patent No.: US 9,598,648 B2
(45) Date of Patent: Mar. 21, 2017

(54) PROCESS, METHOD, AND SYSTEM FOR REMOVING HEAVY METALS FROM FLUIDS

(71) Applicant: Chevron U.S.A. Inc., San Ramon, CA (US)

(72) Inventors: Dennis John O'Rear, Petaluma, CA (US); Wei Wang, Houston, TX (US); Nga Malekzadeh, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 14/923,514

(22) Filed: Oct. 27, 2015

(65) Prior Publication Data

US 2016/0304791 A1 Oct. 20, 2016

Related U.S. Application Data

(60) Provisional application No. 62/149,760, filed on Apr. 20, 2015, provisional application No. 62/073,234, filed on Oct. 31, 2014.

(51) Int. Cl.

| | |
|---|---|
| ***C10G 25/00*** | (2006.01) |
| ***C10G 25/02*** | (2006.01) |
| ***C10G 25/03*** | (2006.01) |
| ***C10G 25/05*** | (2006.01) |
| ***C10G 29/02*** | (2006.01) |
| ***C10G 25/12*** | (2006.01) |
| ***C10G 25/06*** | (2006.01) |
| ***C10G 29/20*** | (2006.01) |
| ***C10G 29/26*** | (2006.01) |
| ***C10G 57/00*** | (2006.01) |

(52) U.S. Cl.

CPC ..... *C10G 29/02* (2013.01); *C10G 25/003* (2013.01); *C10G 25/06* (2013.01); *C10G 25/12* (2013.01); *C10G 29/20* (2013.01); *C10G 29/26* (2013.01); *C10G 57/00* (2013.01); *C10G 2300/205* (2013.01)

(58) Field of Classification Search

CPC ..... C10G 25/00; C10G 25/02; C10G 25/03; C10G 25/05; C10G 29/02

See application file for complete search history.

(56) References Cited

U.S. PATENT DOCUMENTS

| | | | | |
|---|---|---|---|---|
| 3,207,806 | A | 9/1965 | Bajars | |
| 4,336,237 | A | 6/1982 | Kudryk et al. | |
| 4,946,582 | A * | 8/1990 | Torihata | C10G 29/06 208/13 |
| 5,064,626 | A | 11/1991 | Johnson et al. | |
| 5,202,301 | A * | 4/1993 | McNamara | B01J 20/0288 208/251 R |
| 5,354,357 | A | 10/1994 | Markovs et al. | |
| 6,023,942 | A | 2/2000 | Thomas et al. | |
| 7,722,843 | B1 | 5/2010 | Srinivasachar | |
| 8,598,072 | B2 * | 12/2013 | Sato | B01D 15/00 502/413 |
| 8,673,133 | B2 | 3/2014 | Yean et al. | |
| 8,728,303 | B2 | 5/2014 | Young et al. | |
| 2008/0071129 | A1 | 3/2008 | Yang et al. | |
| 2011/0155647 | A1 | 6/2011 | Serban et al. | |
| 2013/0168293 | A1 | 7/2013 | O'Rear et al. | |
| 2013/0306521 | A1 | 11/2013 | O'Rear et al. | |
| 2014/0275694 | A1 | 9/2014 | Cooper et al. | |

OTHER PUBLICATIONS

International Search Report and Written Opinion dated Jan. 14, 2016 for PCT Patent Application No. PCT/US2015/057471.

* cited by examiner

*Primary Examiner* — Randy Boyer

(74) *Attorney, Agent, or Firm* — Howard V. Owens

(57) ABSTRACT

A process for removing non-volatile, particulate mercury from crudes and condensates is disclosed. Particulate mercury in crudes can be removed by a process of first adding a halogen, such as $I_2$. The halogen converts at least 10% of the particulate mercury into an oil-soluble mercury compound that cannot be removed by filtration or centrifugation. This oil-soluble mercury compound can then be removed by adsorption onto a solid adsorbent. The process can operate at near ambient conditions. The adsorption step can be carried out by mixing a particulate adsorbent in the halogen-treated crude and then removing it by centrifugation, desalting, filtration, hydrocyclone or by settling.

21 Claims, No Drawings

PROCESS, METHOD, AND SYSTEM FOR REMOVING HEAVY METALS FROM FLUIDS

TECHNICAL FIELD

The invention relates generally to a process, method, system, and management plan for in-situ removal and control of heavy metals such as mercury from fluids.

BACKGROUND

Heavy metals such as mercury can be present in trace amounts in hydrocarbon gases, crude oils, and produced water. The amount can range from below the analytical detection limit to several thousand ppbw (parts per billion by weight) depending on the source. Crudes containing 50 ppbw total mercury or more are referred to herein as high mercury crudes. When processed in the distillation furnace in a refinery, the particulate mercury in high mercury crudes decomposes to elemental mercury which accumulates in the distillation column overhead, and possibly contaminates the light liquid products and the gas products. In addition, liquid elemental mercury may accumulate in some equipment. If mercury is removed from crude oil, a mercury-containing waste product is generated. In order to minimize the volume and cost of disposal of this waste, it is desired that the waste have as high a mercury content as possible. In addition the mercury in the waste should be essentially non-leachable and pass TCLP (toxicity characteristic leaching procedure) requirements.

There are processes in the prior art to remove mercury in crude oils, but these generate either a gaseous mercury-containing waste product, an aqueous mercury-containing waste product, or a dilute solid waste product that contains less than about 100 ppm Hg and is therefore produced in large volumes. Various methods to remove trace metal contaminants in liquid hydrocarbon feed such as mercury have been disclosed, including the removal of mercury from water by iodide impregnated granular activated carbons. U.S. Pat. No. 5,336,835 discloses the removal of mercury from liquid hydrocarbon using an adsorbent comprising an activated carbon impregnated with a reactant metal halide, with the halide being selected from the group consisting of I, Br and Cl. U.S. Pat. No. 5,202,301 discloses removing mercury from liquid hydrocarbon with an activated carbon adsorbent impregnated with a composition containing metal halide or other reducing halide. US Patent Publication No. 2010/0051553 discloses the removal of mercury from liquid streams such as non-aqueous liquid hydrocarbonaceous streams upon contact with a Hg-complexing agent for mercury to form insoluble complexes for subsequent removal. U.S. Pat. No. 8,728,304 describes the removal of trace element levels of heavy metals such as mercury in crude oil by contacting the crude oil with an iodine source, generating a water soluble heavy metal complex for subsequent removal from the crude oil.

Particulate mercury in crudes presents a challenge to the removal of mercury from crude oil as particulate is more difficult to remove than elemental mercury. While some particulate can be removed by filtration, filtration may not be effective in removing particulate mercury when substantial amounts are present in particles below 0.45 μm in diameter. As adsorption technology does not work well for crude oils and condensates with low levels of mercury, and particularly crude oils containing the non-volatile form of mercury, which has not been well addressed in the prior art.

There is a need for improved methods for the removal of mercury from liquid hydrocarbon steams, especially the non-volatile particulate form of mercury. There is also a need for an improved method to manage, control, and remove mercury in produced fluids from a reservoir, e.g., gas, crude, condensate, and produced water.

SUMMARY

In one aspect, the invention relates to a process to remove mercury from a crude. The process comprises: mixing the crude containing particulate mercury with a halogen to form a digested crude to covert at least 10% of the particulate mercury into an oil-soluble mercury complex in the oil phase, and contacting the digested crude with an adsorbent to remove at least 50% of the total mercury from the digested crude.

The process of adding the halogen followed by adsorption is simple and operates at near ambient conditions. The adsorbent process can either be a fixed bed, ebullated bed, or expanded bed, or CSTR using an extrudate, granule or tableted material. The adsorption can also be done by mixing a particulate adsorbent in the halogen-treated crude and then removing it by centrifugation, desalting, filtration, hydrocyclone or by settling. If elemental mercury is present in the crude, or in a gas in contact with the crude, it too is converted by the halogen into the oil-soluble mercury compound which can be removed by adsorption. The particulate and elemental mercury in the crude is converted into a small volume of solid containing over 100 ppm Hg. The mercury in this solid is essentially non-leachable. Mercury contaminated gas and water streams are not produced. The process results in removal of over 50% of the mercury in the crude, often over 90%.

DETAILED DESCRIPTION

The following terms will be used throughout the specification and will have the following meanings unless otherwise indicated.

"Trace amount" refers to the amount of mercury in the produced fluids. The amount varies depending on the source, e.g., ranging from a few $\mu g/Nm^3$ to up to 30,000 $\mu g/Nm^3$ in natural gas, from a few ppbw to up to 30,000 ppbwin crude oil.

"Volatile mercury" refers to mercury that is present in the gas phase of well gas or natural gas. Volatile mercury is primarily elemental mercury ($Hg^0$) but may also include some other mercury compounds (organic and inorganic mercury species).

"Mercury sulfide" may be used interchangeably with HgS, referring to mercurous sulfide, mercuric sulfide, and mixtures thereof. Normally, mercury sulfide is present as mercuric sulfide with an approximate stoichiometric equivalent of one mole of sulfide ion per mole of mercury ion. Mercury sulfide is not appreciably volatile, and not an example of volatile mercury. Crystalline phases include cinnabar, metacinnabar and hypercinnabar with metacinnabar being the most common.

"Mercury salt" or "mercury complex" means a chemical compound formed by replacing all or part of hydrogen ions of an acid with one or more mercury ions.

"Conversion of Particulate Mercury" refers to the percent reduction in percent particulate mercury that occurs upon treatment of crude with a halogen in accordance with this patent.

Conversion of Particulate Mercury=100*(Initial % Particulate Hg−% Particulate Hg in treated sample)/(Initial % Particulate Hg). The conversion of particulate mercury will be 10% or more, for example 75% or more, or for example 90% or more.

"Crude oil" refers to a liquid hydrocarbon material. As used herein, the term crude refers to both crude oil and condensate. Crude, crude oil, crudes and crude blends are used interchangeably and each is intended to include both a single crude and blends of crudes. "Hydrocarbon material" refers to a pure compound or mixtures of compounds containing hydrogen and carbon and optionally sulfur, nitrogen, oxygen, and other elements. Examples include crude oils, synthetic crude oils, petroleum products such as gasoline, jet fuel, diesel fuel, lubricant base oil, solvents, and alcohols such as methanol and ethanol.

"Digested crude (or condensate)" refers to a crude (or condensate) which has been contacted with a halogen and in which the conversion of particulate mercury is 10% or more. As used herein, "digested crude" also refers to condensate.

"Ebullated Bed" refers to an adsorbent process/system capable of on-stream catalyst replacement. Examples of ebullated beds used in catalytic hydroprocessing service, are known to industry under the trademarks H-Oil® and LC-Fining®. An ebullated or expanded bed reactor system may be defined as a reactor system having an upflow type single reaction zone reactor containing adsorbent in random motion in an expanded catalytic bed state, typically expanded from 10% by volume to about 35% or more by volume above a "slumped" adsorbent bed condition (e.g. a non-expanded or non-ebullated state).

"Essentially in the Liquid State" refers to temperatures and pressures for crude oil that prevent or minimize vaporization. The amount of crude vaporized should be less than 10 wt %, for example less than 1 wt %. In another example the temperature and pressure are at conditions below the crude's or condensate's bubble point. In one embodiment the temperature should be between 10° and 100° C. In another embodiment the temperature should be between 15 and 75° C. In yet another embodiment the temperature should be between 20 and 50° C.

"Essentially non-leachable" refers to an adsorbent from this process that contains mercury. The mercury must be in a form that is not leach in a simulation that the waste will undergo if disposed of in a landfill. To be essentially non-leachable, the mercury in the adsorbent must meet TCLP standards established for the mercury listed in EPA's Land Disposal Restrictions: Summary of Requirements, revised August 2001, document number EPA530-R-01-007.

"Fine-particulate high-mercury crudes (or condensates)" refers to high-mercury crudes or condensates in which in which the proportion mercury containing particles greater than 20 μm is 50 percent or less. In another embodiment it has a percent of 35 or less. In another embodiment it has a percent of 20 or less.

"Halogens" refers to diatomic species from the column of the periodic table headed by fluorine, for example $F_2$, $Cl_2$, $Br_2$, $I_2$, etc. Halogens include mixed species such bromine monochloride, BrCl.

"High mercury crude (or condensate)" refers to a crude or condensate with 50 ppbw or more of total mercury, e.g., 100 ppbw or more of total mercury; or 250 ppbw or more of total mercury, or 1000 ppbw or more of total mercury.

"Ion Exchange Resin" An ion-exchange resin or ion-exchange polymer is an insoluble material normally in the form of small (0.5-1 mm diameter) beads fabricated from an organic polymer substrate. The beads are typically porous, providing a high surface area. The trapping of ions occurs with concomitant releasing of other ions. There are multiple types of ion-exchange resin. Most commercial resins are made of polystyrene sulfonate. Ion-exchange resins are widely used in different separation, purification, and decontamination processes.

"Anion Exchange Resin" is a type of ion exchange resin designed to remove anions. Anion resins may be either strongly or weakly basic. Strongly base anion resins can maintain their positive charge across a wide pH range, whereas weakly base anion resins at high pH. Weakly basic resins do not maintain their charge at a high pH because they undergo deprotonation. They do, however, offer excellent mechanical and chemical stability. This, combined with a high rate of ion exchange, make weakly base anion resins well suited for the organic salts. For anion resins, regeneration typically involves treatment of the resin with a strongly basic solution, e.g. aqueous sodium hydroxide. During regeneration, the regenerant chemical is passed through the resin and trapped negative ions are flushed out, renewing the resins' exchange capacity.

"Mercury sulfide" may be used interchangeably with HgS, referring to mercurous sulfide, mercuric sulfide, or mixtures thereof. Normally, mercury sulfide is present as mercuric sulfide with a stoichiometric equivalent of approximately one mole of sulfide ion per mole of mercury ion. Mercury sulfide can be in any form of cinnabar, metacinnabar, hyper-cinnabar and combinations thereof.

"Molecular Sieves" refers to materials with holes of precise and uniform size. These holes are small enough to block large molecules while allowing small molecules to pass. Molecular sieves are used as desiccants, adsorbents and catalysts. Some examples include activated charcoal, silica gel, zeolites, natural clays, synthetic clays, metal organic frameworks and self-assembled monolayers on mesoporous supports. The diameter of a molecular sieve is measured in Angstroms (Å) or nanometers (nm).

"Metal Organic Frameworks (MOFs)" are a type of molecular sieve consisting of metal ions or clusters coordinated to often rigid organic molecules to form one-, two-, or three-dimensional structures that can be porous. Typically metal organic frameworks are microporous molecular sieves.

"Non-aqueous" means containing less than 2% water.

"Zeolites" are typically microporous, molecular sieves commonly used as commercial adsorbents and catalysts. Compositions of zeolites include silica with alumina (aluminosilicates) and silica with boron (borosilicates).

"Microporous", "Macroporous" and "Mesoporous" refer to materials having pore diameters of less than 2 nm (20 Å), greater than 50 nm (500 Å), and between 2 and 50 nm (20-500 Å), respectively.

"Metal Oxides" are inorganic solids containing of one or more metals and oxygen. These are commonly used in the chemical industry as adsorbents and as supports for catalysts. Examples of metal oxides include alumina, silica, amorphous aluminosilicates and amorphous borosilicates. They are commonly produced as extrudates, chips, powders, granules, or pellets. The extrudates can have a variety of shapes, such as lobes, to assist in adsorption and catalysis. Metal oxides have a range of pore sizes but the average size puts them in the category of mesoporous and macroporous materials.

"Oil-soluble mercury compound" refers to the resulting product when particulate mercury is reacted with a halogen. Oil-soluble mercury compounds demonstrate a reduction in the percent particulate mercury in comparison to the original sample and do not significantly extract into a water phase. Less than 25% will be extracted into an equal volume of deionized water, for example, less than 10%, or for example, less than 5%.

"Organic solution" refers to the dissolution of the halogen in an organic liquid that is soluble in the crude or condensate. By having the halogen dissolved in the organic liquid the halogen rapidly mixes with the crude or condensate, and also rapidly reacts with the particulate mercury. Examples of organic liquids are alcohols (such as methanol or ethanol), naphthas, aromatic solvents, paraffinic solvents, distillates, crude oil, condensates, and blends of these.

"Particulate Mercury" refers to mercury that can be removed by filtration or centrifugation. Solid metacinnabar and cinnabar are examples of species which contribute to particulate mercury. Elemental mercury is not a species that contributes to particulate mercury. Elemental mercury is a non-particulate mercury species.

"Percent Particulate Mercury" refers to the portion of mercury that can be removed from the crude oil by centrifugation or filtration. After the centrifugation the sample for mercury analysis is obtained from the middle of the hydrocarbon layer. The sample is not taken from sediment, water or rag layers. The sample is not shaken or stirred after centrifugation. In one embodiment, percent particulate mercury is measured by filtration using a 0.45 μm filter or by using a modified basic sediment and water (BS&W) technique described in ASTM D4007-11. The sample is heated in accordance with the procedure. If the two methods are in disagreement, the modified BS&W test is used. The modifications to the BS&W test includes: omission of dilution with toluene; demulsifier is not added; and the sample is centrifuged two times with the water and sediments values measured after each time. If the amount of sample is small, the ASTM D4007-11 procedure can be used with smaller centrifuge tubes, but if there is disagreement in any of these methods, the modified basic BS&W test is used with the centrifuge tubes specified in ASTM D4007-11. Crudes and condensates of this invention will have a percent particulate mercury of 10 percent or more. In another embodiment, they will have a percent particulate mercury of 25 percent or more. In another embodiment, they will have a percent particulate mercury of 50 percent or more.

"Percent fine particulate mercury" is limited to crude or condensates in which the mercury is predominantly non-volatile. It refers to the portion of mercury that cannot be removed from crude oil by vacuum filtration using a 0.45 μm filter at room temperature for crude oils that are fluid at room temperature, or at 10° C. above the pour point for crudes that are not fluid at room temperature. The filtration uses 25 mL samples of crude in 47 mm filters in glass vacuum filtration apparatus. If the crude is fluid at room temperature, the filtration is done at room temperature. If the crude is not fluid at room temperature, it is heated to approximately 10° C. above its pour point.

"Percent volatile mercury" is measured by stripping 15 ml of crude or condensate with 300 ml/min of nitrogen ($N_2$) for one hour. For samples which are fluid at room temperature, the stripping is carried out at room temperature. For samples which have a pour point above room temperature, but below 60° C., the stripping is done at 60° C. For samples which have a pour point above 60° C., the stripping is at 10° C. above the pour point. Mercury is measured on the original and stripped crude by the methods described under "Total Mercury." During stripping some oil may be evaporated along with the volatile mercury. This evaporation will concentrate the non-volatile mercury in the stripped crude. To correct for this concentration by evaporation, the loss in crude by evaporation is determined by weighing the initial crude and stripped crude. The percent loss in crude by evaporation is used to correct the total mercury determined in the stripped crude. This corrected value is then used to determine the percent volatile mercury.

"Predominantly non-volatile (mercury)" in the context of crudes or condensates means that the percent volatile mercury is less than 50%. In another embodiment, the percent volatile mercury is less than 25% of the mercury. In yet another embodiment, the percent volatile mercury is less than 15%.

"Self-Assembled Monolayers on Mesoporous Supports®" have been developed by the Pacific Northwest National Laboratory. They are also trademarked as SAMMS™. These can also be modified by use of thiols. An example of the preparation and use of thiol-modified SAMMS™ for the removal of cationic mercury dissolved in water is described in Prepr. Pap.-Am. Chem. Soc., Div. Fuel Chem. 2004, 49 (1), 288.

"Selenium modified adsorbent" is the selenium analog of any of the following sulfur-containing adsorbents: sulfur-containing polymer, sulfur treated metal oxides, sulfur-treated carbon and thiol-modified SAMMS™. The selenium can be incorporated by use of any selenium reagent, including organic selenides (RSeH) where R is an alkyl, aryl or other carbon-containing ligand, Selenous acid, etc.

"Sulfur-Containing Polymer" is a polymer containing sulfur groups, such as thiophene or thiourea. The sulfur groups can be either part of the polymer backbone or on side chains.

"Sulfur-treated metal oxides and Sulfur-treated carbon" refers to metal oxides and carbon respectively that have been treated with a sulfur compound. Examples of the sulfur compounds include thiosulfates, polysulfides, thiourea, and combinations thereof. The percent sulfur in the sulfur-treated metal oxide or carbon is greater than or equal to 1% and less than or equal to 90%. In another embodiment, the percent sulfur is greater than or equal to 5% and less than or equal to 50%. In yet another embodiment, the percent sulfur is greater than or equal to 10% and less than or equal to 30%.

"Sulfur-treated MOFs" are MOFs that are have thiol functionality added.

"Total Mercury" is the sum of all mercury species and phases present in a sample. It is measured by Lumex or other appropriate alternative method for crudes having more than 50 ppbwmercury. If an alternative method does not agree with a Lumex measurement, the Lumex measurement is used. For crudes having less than 50 ppbwmercury, the total mercury is measured by CEBAM analysis or other appropriate alternative method. If an alternative method does not agree with a CEBAM measurement, the CEBAM measurement is used.

"Trace amount" refers to the amount of mercury in the crude oil. The amount varies depending on the crude oil source and the type of heavy metal, for example, ranging from a few ppbw to up to 100,000 ppbw for mercury and arsenic.

"Volatile Mercury" refers to mercury that can be removed by stripping with nitrogen. Elemental mercury is an example of a species which contributes to volatile mercury. Cinnabar and metacinnabar are examples of species which do not contribute to volatile mercury. Cinnabar and metacinnabar are examples of non-volatile mercury species.

Mercury in crudes (and condensates) is predominantly non-volatile and a portion can be removed by laboratory filtration or centrifugation. The portion which can be removed by centrifugation is called particulate mercury. While filtration and centrifugation are a convenient laboratory method to characterize the mercury contents of crudes, it is difficult and often impractical to filter or centrifuge crudes commercially. Particulate mercury in crudes can be removed by a process of first adding a halogen, such as $I_2$. The halogen converts at least 10% of the particulate mercury into an oil-soluble mercury compound that cannot be removed by filtration or centrifugation. This oil-soluble mercury compound can then be removed by adsorption onto a solid adsorbent.

In one aspect, the invention relates a process to remove mercury from crudes and condensates, that does not generate gaseous or liquid mercury-containing waste products; which removed particulate mercury, especially fine particulate mercury present in particles below 0.45 μm; which produces a concentrated solid waste product containing more than 100 ppm Hg; and which also removes elemental mercury in the crude oil or in a gas that is in contact with the crude oil.

In another aspect, the invention relates to a process that can be used in field locations where crude oil is produced and on off-shore processing facilities. In these locations, fired furnaces are either difficult to install or are very expensive to build and operate, thus operation at temperature at or below 100° C. is needed. The inventive process can operate at near ambient temperature and pressure.

In crude oils containing more than 50 ppbw mercury, the percent mercury in particles which can be removed by laboratory filtration centrifugation is over 25% with an average of 73%. It is believed that the remaining 27% mercury is primarily in the form of fine particles. It was also found that in most samples of crude oils and condensates, the predominant form of mercury is non-volatile, and not elemental mercury $Hg^0$ which is volatile. It is known in the art that volatile mercury is readily removed from hydrocarbons upon stripping or sparging with a low mercury gas stream. Quantitative Reitveld XRD analysis of the recovered solids from a crude sample show the most abundant mercury phase to be metacinnabar (HgS) and this is assumed to be the predominant mercury species in crude oil.

In one embodiment, a high mercury crude oil is mixed with a halogen, such as $I_2$, to convert at least 50% of the particulate mercury into an oil-soluble mercury compound, and removing the oil-soluble mercury compound with an adsorbent. The $I_2$/Hg molar ratio ranges from 0.1-1000 in one embodiment; from 1-100 in a second embodiment; from 10-50 in a third embodiment.

The process operates at near ambient conditions: at temperatures above the pour point of the crude, and at sufficient pressure to maintain the crude oil or condensate essentially in the liquid state. The process removes more than 50% of the total mercury in the crude, for example more than 90%. The product contains less than 500 ppbw total mercury, for example less than 200 ppb, or less than 100 ppb, or less than 50 ppbw. The adsorbent is highly effective in removing the oil-soluble mercury compound. It can contain 100 ppm mercury or more, for example 500 ppm or more, or over 1000 ppm or more.

The process works on crudes with any size distribution of mercury particles. For example, it will work on fine-particulate high mercury crudes. Without wishing to be bound by theory, we propose that particulate mercury in crudes in present as nanometer scale metacinnabar (HgS) and these fine particles are primarily adsorbed on the exterior surface of micrometer-sized particles. The micrometer-sized particles are formation material that remains suspended in the crude. Some HgS may be present as micron-sized aggregates of the nanometer scale metacinnabar particles. Fine particles of metacinnabar may also be present as free particles and not associated with formation material. The fine particles of metacinnabar have crystal sizes determined by EXAFS coordination numbers in the 5 to 10 nanometer size range. The formation particles and the aggregates have sizes in the range of 0.1 to 100 μm.

The fine particles of metacinnabar react with the halogen to form a neutral-valent halide. Without wishing to be bound by theory, we propose that the oil-soluble mercury compound is a neutral-valent halide. An example for iodine is: $HgS+I_2\ HgI_2^0+S$. Not the entire oil-soluble mercury compound is necessarily dissolved in the oil as a molecular species. Some may still be removed by filtration and centrifugation. The reaction product between HgS and the halide may remain associated with the other particulate matter that initially held the HgS. But the Hg in the treated crude is nevertheless removable by the adsorbent. Without wishing to be bound by theory, it is assumed that when the reaction product remains associated with the other particulate matter, and is removed by adsorption, the entire mass of the particle becomes fixed to the adsorbent.

The form of the sulfur in the product is not known, but it is not relevant to the invention. The neutral-valent halide is soluble in the crude oil and cannot be removed by centrifugation or filtration. Mercury halides are volatile, like elemental mercury and unlike particulate mercury sulfide.

If the particulate mercury in the crude or condensate is composed of a large fraction of particles greater than 20 μm, processes like filtration, centrifugation, hydrocyclone and settling can be effective. The process of this invention is best suited for crudes and condensates the proportion mercury containing particles greater than 20 μm is 50 percent or less, even 35 percent or less, and even 20 percent or less.

The low water solubility of the oil-soluble mercury compound is important because this minimizes the chance of contamination of water with mercury. The reaction can be done in the presence of a separate water phase without creating significant contamination of the water. The volume ratio of water to crude can be in the range of 0.01-1000; 0.1-100; or 1-10.

The oil-soluble mercury reaction product can be adsorbed on a variety of solid adsorbents. Examples include sulfur-containing polymers, anion exchange resins, molecular sieves, zeolites, metal organic framework (MOF) materials, metal oxides and carbon treated with sulfur compounds. Examples of metal oxides include silicas, aluminas, silica-aluminas, zeolites, borosilicates, clays, synthetic layered materials such as hydrotalcite, zirconia, titania, diatomaceous earth, and composites such as fluid catalytic cracking (FCC) catalyst. Examples of the sulfur compounds used to treat the oxides include polysulfides, and thiosulfates.

Non-volatile mercury species in crude are believed to be essentially particulate mercury of different size ranges. The halogens in this process convert all the particulate mercury into an oil soluble mercury species. But portions can remain associated with other particles of formation material.

Various processes well-known in the industry are available for adsorption. The adsorption can be performed using extrudates, granules or tablets in a fixed bed where the halogen treated crude flows either downflow (i.e., downward) or upflow (i.e., upward). Fixed beds may encounter plugging problems due to the fines in the crude. One way to prevent this is to use a guard bed of high pore volume material to capture the particles and prevent formation of a non-porous crust. The adsorption process can also be performed in a fluidized bed or ebullated bed. These options are suitable for use when the total particulate content of the crude is high enough to cause plugging in a fixed bed even with use of a guard bed. Alternatively, the formation of plugs can be prevented by use of sonication or pulsed flow. Both gently agitate the particles and prevent the formation of a crust. The adsorption can also be performed using fine particulate adsorbents which are mixed with the crude and then removed by settling, filtration, centrifugation, hydrocyclone and combinations thereof Multiple adsorbent units of any type can be used in series. Typically this is a lead-lag operation where the first adsorber (lead) is removing the majority of the mercury and the second adsorber (lag) removes the final traces. When the first adsorber is spent and mercury concentrations in the outlet of the first adsorber increase, the inlet flow is reversed to the second adsorber and the first adsorber it taken off-line to replace the adsorbent. It is then brought back on-line and operates in the lag position.

When an adsorbent is used in a fixed bed, fluidized bed, ebullated bed or expanded bed, the space velocity should be greater than or equal to 0.01 $h^{-1}$. In another example, greater than or equal to 0.1 and less than or equal to 25 $hr^{-1}$. In another example, greater than or equal to 1 and less than or equal to 5 $hr^{-1}$. For ebullated or expanded beds, the space velocity should be based on the bed volume before ebullition or expansion.

When a particulate adsorbent is mixed with the treated crude, the amount of adsorbent added should be greater than 0.001 wt % in one embodiment; from 0.01-10 wt % in a second embodiment; and 0.1-2 wt % in a third embodiment.

A portion of the particulate mercury can be removed in advance of this process by use of filtration, centrifugation, hydrocyclone and settling. These remove the larger particles and reduce the need for the halogen reagent. In addition to removing mercury from iodine-treated crudes and condensates, the adsorbent can remove at least a portion of the residual iodine species: unreacted iodine, HI, organic iodide and complexes. By removing these species, concern over corrosion from iodine is reduced. The residual iodine in the crude is no greater than 25 ppm in one embodiment; no greater than 10 ppm in a second embodiment; no greater than 5 ppm in a third embodiment; and no greater than 1 ppm in a fourth embodiment.

Iodine is an expensive reagent and it is preferable to recover it from the adsorbent. Iodine can be recovered from solids and liquids by technology well known in the industry. This technology is described in Ullmann's Encyclopedia of Industrial Chemistry, Published Online: 15 Jun. 2000. Capther Iodine and Iodine Compounds by Phyllis A. Lyday, incorporated herein by reference. The spent adsorbents in from this process are unique in that they will contain both iodide and the iodine-mercury reaction product and possibly some iodine and organic iodine compounds. The adsorbents can be treated with chlorine ($Cl_2$) to oxidize the various iodine forms to $I_2$. This will convert the mercury to $HgCl_2$. The boiling points of $I_2$ and $HgCl_2$ are respectively 184 and 304° C. Thus these two species can be separated by distillation. Other approaches to separate these species include ion exchange, adsorption, and fractional crystallization. Optionally at least a portion of the iodide and iodine in the spent adsorbent is recovered as iodine ($I_2$) and recycled to the process. Likewise bromine can be recovered in the same fashion.

EXAMPLE 1

In this example, a sample of volatile $Hg^0$ in simulated crude was prepared. First, five grams of elemental mercury $Hg^0$ was placed in an impinger at 100° C. and 0.625 SCF/min of nitrogen gas was passed over through the impinger to form an Hg-saturated nitrogen gas stream. This gas stream was then bubbled through 3123 pounds of Superla® white oil held at 60-70° C. in an agitated vessel. The operation continued for 55 hours until the mercury level in the white oil reached 500 ppbw by a Lumex™ analyzer. The simulated material was drummed and stored.

EXAMPLE 2

The example illustrates the stripping of volatile $Hg^0$ from a crude. First, 75 ml of the simulated crude from Example 1 was placed in a 100 ml graduated cylinder and sparged with 300 ml/min of nitrogen at room temperature. The simulated crude had been stored for an extended period of time, e.g., months or days, and its initial value of mercury had decreased to about 369 ppbw due to vaporization (at time 0). The mercury in this simulated crude was rapidly stripped consistent with the known behavior of $Hg^0$, as shown in Table 1. The effective level of mercury at 60 minutes is essentially 0 as the detection limit of the Lumex™ analyzer is about 50 ppbw.

TABLE 1

| Time, min | Mercury, ppbw |
|---|---|
| 0 | 369 |
| 10 | 274 |
| 20 | 216 |
| 30 | 163 |
| 40 | 99 |
| 50 | 56 |
| 60 | 73 |
| 80 | 44 |
| 100 | 38 |
| 120 | 11 |
| 140 | 25 |
| Pct Volatile Hg | 80 |

Superla® white oil is not volatile and there were no significant losses in the mass of the crude by evaporation. Thus the mercury analyses of the stripped product did not need to be corrected for evaporation losses.

The mercury in this crude is volatile. Filtering this simulated crude through a 0.45 μm syringe filter to avoid losses of volatile mercury resulted in no change in the mercury content. This in an example of a volatile mercury crude and a non-particulate mercury crude.

EXAMPLES 3-8

Determination of the Percent Volatile Mercury in Crudes by Stripping. The mercury content in the vapor space of these six samples was measured by a Jerome analyzer and found to be below the limit of detection. Thus this indirect qualitative method indicates that there is no volatile mercury in these samples.

The initial total mercury content of the six samples was determined and then the samples were stripped as indicated. The loss of weight of crude by evaporation was determined, and the total mercury in the stripped crude was measured. The percent volatile mercury was determined from these values based on a corrected value for the stripped total mercury to account for losses in the crude by evaporation using the following formula.

Percent volatile Hg=100*(Total Hg in the original sample)−[(100−% Oil Loss)*

(Hg in stripped sample)/100]/(Total Hg in the original sample)

All samples contained predominantly non-volatile mercury. Experiment 6 was with a crude. Other experiments were with condensate samples. Results are summarized in Table 2.

TABLE 2

| | Examples | | | | | |
|---|---|---|---|---|---|---|
| | 3 | 4 | 5 | 6 | 7 | 8 |
| Volatile Hg by Jerome, μg/m$^3$ | 0.00 | 0.00 | 0.00 | 0.00 | 0.00 | 0.00 |
| Total Hg by Lumex (or CEBAM), ppb | 2,102 | 1,388 | 1,992 | 9,050 | 748 | 505 |
| Hg after 1 hr RT stripping, ppb | 2,357 | 1,697 | 2,787 | 8,951 | 748 | 532 |
| Oil loss after 1 hr RT stripping, wt % | 14.00 | 10.83 | 30.01 | 16.01 | 9.28 | 14.72 |
| Percent Volatile Hg | 4 | −9 | 2 | 17 | 9 | 10 |

All these crudes and condensates are examples of predominantly non-volatile mercury-containing crudes and condensates.

Volatile mercury compounds, such as elemental mercury, can be found in crudes and condensates sampled near the well-head. These have not been stabilized to remove light hydrocarbon gases (methane, ethane, propane, and butanes). The stabilization process typically removes most if not all of the elemental mercury from crudes and condensates.

EXAMPLES 9 TO 21

Size Distribution of Particulate Mercury in Crudes and Condensates. Ten crude and condensate sample were vacuum filtered through 47 mm filters with pore sizes of 20, 10, 5, 1, 0.45 and 0.2 μm. Examples 9-10, 13-16, and 19 are crude samples. The temperature of the filtration was set above the crude pour point. The total mercury in the crudes, condensates and their filtrates was determined by Lumex™. The amount of mercury in each size fraction was determined by comparing the amount removed in successive filter sizes. On occasion, this resulted in negative numbers, which should be interpreted as meaning that there was little or no particulate mercury in this size range. Results are summarized in Table 3.

TABLE 3

| Exp. No | Filt. Temp, C. | Hg, ppb | Percent Hg removed in each size fraction >20 μm | 10-20 μm | 5-10 μm | 1-5 μm | 0.45-1 μm | 0.2-0.45 μm | <0.2 μm | % Part. Hg >0.45 μm | % Part. Hg By Cent. |
|---|---|---|---|---|---|---|---|---|---|---|---|
| 9 | 65 | 1,947 | 42 | 10 | 1 | −4 | 34 | 1 | 16 | 83 | |
| 10 | 70 | 1,256 | 35 | 18 | 21 | 7 | 4 | 0 | 16 | 84 | |
| 11 | Room Temp. | 2,102 | 89 | 5 | −3 | 3 | 6 | 1 | 0 | 99 | 92 |
| 12 | 48 | 1,510 | 3 | 0 | 8 | 12 | 3 | −2 | 76 | 26 | 22 |
| 13 | 70 | 230 | 19 | 10 | 19 | −2 | 25 | 1 | 28 | 71 | |
| 14 | 70 | 360 | 16 | 8 | 9 | −1 | 24 | 2 | 43 | 55 | |
| 15 | 70 | 429 | 9 | −8 | 19 | −2 | 32 | 2 | 48 | 50 | |
| 16 | 70 | 940 | 14 | 59 | 14 | 0 | 5 | 0 | 8 | 92 | |
| 18 | 40 | 2,021 | 11 | 3 | 15 | −14 | 29 | −1 | 57 | 45 | 31 |
| 19 | Room Temp. | 9,050 | 16 | 16 | 11 | 32 | 20 | 1 | 4 | 95 | 69 |
| 20 | Room Temp. | 748 | 3 | 2 | 25 | 8 | 17 | 2 | 43 | 55 | 52 |
| 21 | Room Temp. | 505 | 34 | 49 | 0 | −2 | 13 | −2 | 8 | 94 | 82 |

The data shows that the size distribution of mercury-containing particles in crudes and condensates varies significantly. The presence of fine particles, those with sizes of 0.45 μm and below, will present a problem for processes which remove mercury particles by filtration, centrifugation or settling.

All of these are examples of high mercury crudes and high mercury condensates. All of these have a percent particulate mercury concentration of 10% or more. All these except number 11 are examples of fine-particulate high-mercury crudes and condensates.

Mercury which passes through the smallest filter tested, 0.2 μm, is believed to be fine metacinnabar particles. EXAFS analysis of a series of solids removed from crudes detects only metacinnabar, and on occasion, a small amount of related solid mercury dithiol species with EXAFS structures matching the mercury-cysteine complex.

The percent particulate Hg is measured by filtration using a 0.45 μm filter and by centrifugation (data from Table 5).

For most examples, the two methods agree. When they differ, the method described in the definition should be used.

EXAMPLES 22 TO 26

In these examples, metacinnabar are determined as the Hg species in stabilized crude. The examples show that the predominant form of mercury in solid residues from various stabilized crudes is metacinnabar. The metacinnabar particles are either very small (nanometer scale), highly disordered, or both.

Solid residues from several crudes were analyzed by EXAFS to determine the composition of the solids components. The mercury coordination number (CN) was also measured. Efforts were made to look for other species, but they could not be detected and must be present at levels much less than 10%. The searched-for species include: elemental mercury (on frozen samples), mercuric oxide, mercuric chloride, mercuric sulfate, and $Hg_3S_2Cl_2$. Also the following mineral phases were sought and not found: Cinnabar, Eglestonite, Schuetite, Kleinite, Mosesite, Terlinguite. Results are shown in Table 4, showing a summary of Hg species identified in the samples and the calculated first shell coordination number for each Hg species.

TABLE 4

| Example | Species (%) | Coordination number |
|---|---|---|
| 22 | B-HgS (101) | 2.61 ± 0.26 |
| | HgSe (10) | |
| 23 | B-HgS (91) | 2.40 ± 0.98 |
| | Hg-$(SR)_2$ (24) | 1.22 ± 0.85 |
| 24 | B-HgS (104) | 2.61 ± 0.17 |
| 25 | B-HgS (139) | 3.46 ± 0.21 |
| 26 | B-HgS (129) | |

The percentages of mercury in the samples were calculated by comparison to standards and with measurement of the mercury content of the sample. Metacinnabar (B—HgS) is the predominant species for all stabilized crudes obtained from around the world. On occasion traces of mercury selenide are seen. Higher amounts of related mercury dithiol (Hg—$(SR)_2$) can be seen in samples that are not washed with toluene solvent. The dithiol is believed to be an intermediate product from the reaction between elemental mercury and mercaptans. It eventually condenses to form metacinnabar which adsorbs on the surface of the formation material. The standard used for analysis of the dithiol was HgCysteine. The coordination numbers below 4 indicate that the metacinnabar crystallites are either very small (nanometer scale), or are very poorly crystalized, or both.

SEM and TEM studies show that the metacinnabar can be present as either micron-sized aggregates of nanometer sized metacinnabar crystallites, or as nanometer sized metacinnabar crystallites coating the outside of other micron-sized solids, typically formation material, e.g., quartz, clay and the like. Because the metacinnabar crystallites are in the nanometer size range, they are difficult or impossible to detect by conventional XRD because of line broadening. The metacinnabar nanoparticles can also be converted to diethyl mercury using ethyl chloride. Reagent metacinnabar powders show little or no reactivity presumably due to their lower surface area and larger crystal size.

EXAMPLES 27 TO 33

Determination of Percent Particulate Hg by Centrifugation. Ten ml of the following seven condensates and crudes (Example 31) were placed in a small centrifuge tube. Samples that were fluid at room temperature were centrifuged at room temperature. Samples that were waxy at room temperature were heated to 40° C. The samples were spun at 1800 RPM for 10 minutes. The mercury content of the supernatant was measured by Lumex™ and compared to the mercury content of the original sample, and the ratio was used to calculate the percent particulate mercury. Results are summarized in Table 5.

TABLE 5

| Example | Percent Particulate Hg by Centrifuge |
|---|---|
| 27 | 92 |
| 28 | 80 |
| 29 | 22 |
| 30 | 31 |
| 31 | 69 |
| 32 | 52 |
| 33 | 82 |

Percent Particulate Mercury=100*(Original Hg−Centrifuged Hg)/(Original Hg)

EXAMPLES 34 AND 35 (COMPARATIVE EXAMPLES, NOT OF THE INVENTION)

These examples show that commercial adsorbents designed to remove elemental mercury from liquids and gases are highly effective in removing volatile elemental mercury from this simulated crude.

Adsorbents used commercially to remove elemental mercury from hydrocarbon liquids include copper-alumina and clay-containing materials. Adsorbents of both classes were evaluated. The clay-adsorbent contained Attapulgite.

0.1 grams of each material were placed in 40 ml VOA vials. 10 ml of the volatile Hg0 in simulated crude from example 1 was added. These were then mixed overnight on a rotating disc and allowed to settle. The final mercury content of the supernatant was compared to the initial Hg, and used to calculate the percent removed by adsorption and settling. The results are shown in Table 6 below.

TABLE 6

| Example | Adsorbent | Initial Hg, ppb | Final Hg, ppb | Percent Removed |
|---|---|---|---|---|
| 34 | Copper-Alumina | 380 | 18 | 95.25 |
| 35 | Attapulgite | 380 | 26 | 93.16 |

Both materials are highly effective in removing volatile elemental mercury from this simulated crude.

EXAMPLES 36 TO 41 (COMPARATIVE EXAMPLES)

These examples show that commercial adsorbents designed to remove elemental mercury from liquids and gases are ineffective in removing non-volatile particulate mercury from crude oil.

The adsorbents of examples 34 and 35 were tested as described above in Examples 22 and 23 but with a crude and a condensate. The crude had an average particle size determined by filtration of 11 μm. The condensate had a smaller average particle size of 6 μm. Since the mercury in these samples is particulate, some amount will settle in the absence of an adsorbent. The effectiveness of an adsorbent must be judged by the increase in removal compared to settling without an adsorbent. Examples 36-38 are with a crude. Examples 39-41 are with a condensate. Results are shown below in Table 7.

TABLE 7

| Example | Adsorbent | Percent Removed |
|---|---|---|
| 36 | None-Control | 32 |
| 37 | Copper-alumina | 39 |
| 38 | Attapulgite | 17 |
| 39 | None-Control | 37 |
| 40 | Copper-alumina | 0 |
| 41 | Attapulgite | 25 |

These results show that the adsorbents which work well to remove elemental mercury are ineffective in removing non-volatile particulate mercury; the amount removed was the same as was removed by settling alone in the absence of an adsorbent.

EXAMPLES 42 TO 65

The digestion of particulate mercury by use of iodine was studied on a series of crudes and condensates at various ratios of $I_2$/Hg. The iodine was dissolved in methanol to make an 8 wt % solution. Aliquots of this solution were added to various crudes and condensates, mixed for thirty minutes and then centrifuged for 10 minutes at room temperature and 1,800 RPM. The percent particulate mercury was determined from a ratio of the initial mercury to the mercury content of the supernatant after centrifugation.

Percent particulate Hg=100*(Initial Hg−Hg after Centrifugation)/(Initial Hg).

If the mercury content of the sample after filtration is greater than the mercury content before filtration, the percent particulate mercury is apparently less than zero, but this is due to the accuracy of the measurement.

Results are shown below in Table 8.

TABLE 8

| Condensate 1,192 ppbwHg | | | | |
|---|---|---|---|---|
| | Example No. | | | |
| | 42 | 43 | 44 | 45 |
| $I_2$/Hg Molar Ratio | 0.00 | 4.59 | 10.50 | 21.82 |
| Percent Particulate | 92.74 | 63.07 | 8.59 | 44.05 |
| Conversion of Particulate Hg | | 31.99 | 90.74 | 52.50 |
| **Condensate 2,992 ppbwHg** | | | | |
| | Example No. | | | |
| | 46 | 47 | 48 | 49 |
| $I_2$/Hg Molar Ratio | 0.00 | 5.37 | 10.75 | 50.76 |
| Percent Particulate | 21.70 | −7.89 | −2.54 | 0.02 |
| Conversion of Particulate Hg | | >100 | >100 | 99.91 |
| **Crude 3,198 ppbwHg** | | | | |
| | Example No. | | | |
| | 50 | 51 | 52 | 53 |
| $I_2$/Hg Molar Ratio | 0.00 | 6.43 | 11.81 | 25.30 |
| Percent Particulate | 76.08 | 67.65 | 36.50 | 9.42 |
| Conversion of Particulate Hg | | 11.08 | 52.02 | 87.62 |

TABLE 8-continued

| Crude 6,392 ppbwHg | | | | |
|---|---|---|---|---|
| | Example No. | | | |
| | 54 | 55 | 56 | 57 |
| $I_2$/Hg Molar Ratio | 0.00 | 1.83 | 7.58 | 15.17 |
| Percent Particulate | 85.05 | 83.09 | 45.51 | 24.73 |
| Conversion of Particulate Hg | | 2.30 | 46.49 | 70.92 |
| **Condensate −4 821 ppbwHg** | | | | |
| | Example No. | | | |
| | 58 | 59 | 60 | 61 |
| $I_2$/Hg Molar Ratio | 0.00 | 4.47 | 8.81 | 22.09 |
| Percent Particulate | 81.74 | 65.78 | 26.25 | 42.73 |
| Conversion of Particulate Hg | | 19.53 | 67.89 | 47.72 |
| **Condensate −5 505 ppbwHg** | | | | |
| | Example No. | | | |
| | 62 | 63 | 64 | 65 |
| $I_2$/Hg Molar Ratio | 0.00 | 4.48 | 8.76 | 22.20 |
| Percent Particulate | 74.96 | 54.33 | 66.32 | 32.06 |
| Conversion of Particulate Hg | | 27.52 | 11.53 | 57.23 |

These results show that adding a halogen, iodine in this case, to the crude oil reduces the particulate Hg. Without wishing to be bound by theory, we believe the product is neutral $HgI_20$. Some of this is dissolved in the crude, and part may remain associated with the particles.

In these experiments, the reduction in the particulate mercury varies depending on the crude and the $I_2$/Hg ratio. The reduction in the particulate mercury varies from 2.3% (Example 55 compared to 54) to approximately 100% (Examples 47 to 49 compared to 46). Increasing the $I_2$/Hg ratio generally leads to a greater conversion of particulate mercury.

The reduction in the particulate mercury in the crude oil is greater than or equal to 10%. In one embodiment, the reduction is greater than or equal to 50%. In another embodiment, the reduction is greater than or equal to 75%.

EXAMPLES 66 TO 93

A third sample of a crude containing 3,032 ppbw total mercury as measured by Lumex™ was used in these examples. An eight percent solution of iodine in methanol was prepared by dissolving 8.25 grams of iodine crystals in 100 grams of methanol.

The mercury in this crude was digested by hand mixing of 120 mL of crude with 156 μL of the eight percent iodine in methanol. This corresponds to a 25:1 $I_2$-Halogen molar ratio.

One tenth of a gram of various adsorbents was placed in a 40 mL VOA vial. 10 mL of the digested crude were placed in the vial. The vial was sealed and placed on a rotating disc overnight. In the morning the digested and treated crude was sampled and a portion passed through a 0.45 μm syringe filter. The filtrate was analyzed for total mercury by Lumex™.

Two controls were run and are not part of the invention. Example 64 was the untreated crude. The 0.45 μm syringe filter removed 92.21 percent of the mercury thus showing that the mercury this high mercury crude is particulate. Example 65 was for the iodine treated crude without an adsorbent. In this case only 18.75 percent of the mercury could be removed by the syringe filter. The conversion of particulate mercury by addition of the iodine is eighty percent.

The various adsorbents include: a thiosulfate bound polymer commercially available from Sigma Aldrich (ID 589977); a carbon powder also from Sigma Aldrich as Darco® carbon (ID 242276); activated carbon from Sigma Aldrich as C2889; a mesoporous carbon from Sigma Aldrich as 702110; diatomaceous earth (DE) from Eagle Picher of Cincinnati Ohio as Celatom® DE; silica gel Sorbtech with size 60 Å, 40-63 μm (230×400 mesh); FCC equilibrium catalyst obtained from a refinery and screened to remove fines; alumina extrudate with 220 $m^2/g$ surface area and 100 Å average pore size; and anion exchange resins obtained from Siemens.

These adsorbents were tested as is. In addition the carbons, silica gel, FCC catalyst, alumina, and a sample of diatomaceous earth (DE) were impregnated aqueous solutions of 20% sodium thiosulfate (Sigma Aldrich), 30% sodium polysulfide (TETRAGARD), or 49% ammonium polysulfide (Cyntrol 2045). Ten grams of the adsorbents were placed in a beaker. The solutions were added drop-wise until wetness was observed. The mass was mixed and dried overnight in a 60° C. oven. In the morning the dried impregnated adsorbent was broken apart and stored. The materials prepared this way are examples of sulfur-treated metal oxides and sulfur-treated carbons. The sulfur content of the adsorbents is shown below in Table 9.

TABLE 9

| Support | Wt % S as Thiosulfate | Wt % S as Sodium Polysulfide | Wt % S as Ammonium Polysulfide |
|---|---|---|---|
| Darco Carbon | 5.99 | 18.55 | 27.34 |
| Diam. Earth (DE) | 6.01 | 17.00 | 27.93 |
| FCC Catalyst | 4.93 | 12.88 | 19.41 |
| Silica Gel | 5.37 | 15.80 | 25.38 |
| $Al_2O_3$ Extrudate | 5.17 | 14.97 | 16.69 |

The mercury content on the adsorbent was calculated from the weights of the adsorbent and crude (or condensate) and the change in total mercury contents. Direct measurement of the mercury content on the adsorbent was difficult due to the small amount of sample and contamination with crude and filter cloth residue. Results from testing these materials are summarized in Table 10.

TABLE 10

| Ex. No. | Crude | Adsorbent | Ads. grams | Sol. Hg, Ppb | Calculated Hg on Ads. ppm | % Hg Removed |
|---|---|---|---|---|---|---|
| 66 | Untreated Crude-3 | None | 0.0000 | 236 | | 92.21 |
| 67 | 25:1 $I_2$/Hg treated Crude | None | 0.0000 | 2463 | | 18.75 |
| 68 | 25:1 $I_2$/Hg treated Crude | Thiosulfate polymer | 0.1154 | 273 | 208 | 91.01 |
| 69 | 25:1 $I_2$/Hg treated Crude | Darco Carbon | 0.1090 | 1057 | 158 | 65.14 |
| 70 | 25:1 $I_2$/Hg treated Crude | Activated Carbon | 0.1193 | 1213 | 133 | 59.98 |
| 71 | 25:1 $I_2$/Hg treated Crude | Mesoporous Carbon | 0.1030 | 1097 | 163 | 63.83 |
| 72 | 25:1 $I_2$/Hg treated Crude | Silica Gel | 0.1120 | 1545 | 116 | 49.05 |
| 73 | 25:1 $I_2$/Hg treated Crude | FCC Catalyst | 0.1135 | 1142 | 145 | 62.32 |
| 74 | 25:1 $I_2$/Hg treated Crude | Siemens A-244OH | 0.1109 | 571 | 193 | 81.18 |
| 75 | 25:1 $I_2$/Hg treated Crude | Siemens A-464OH | 0.1109 | 513 | 198 | 83.08 |
| 76 | 25:1 $I_2$/Hg treated Crude | Siemens A-674OH | 0.1159 | 512 | 189 | 83.12 |
| 77 | 25:1 $I_2$/Hg treated Crude | Siemens A-714OH | 0.1150 | 418 | 198 | 86.22 |
| 78 | 25:1 $I_2$/Hg treated Crude | Siemens A-284C | 0.1148 | 486 | 193 | 83.98 |
| 79 | 25:1 $I_2$/Hg treated Crude | Darco + Thiosulfate | 0.1052 | 1271 | 146 | 58.07 |
| 80 | 25:1 $I_2$/Hg treated Crude | DE + Thiosulfate | 0.1200 | 509 | 183 | 83.21 |
| 81 | 25:1 $I_2$/Hg treated Crude | FCC + Thiosulfate | 0.1065 | 1318 | 140 | 56.51 |
| 82 | 25:1 $I_2$/Hg treated Crude | Silica Gel + Thiosulfate | 0.1066 | 165 | 233 | 94.55 |
| 83 | 25:1 $I_2$/Hg treated Crude | $Al_2O_3$ Ext. + Thiosulfate | 0.1053 | 1197 | 152 | 60.51 |
| 84 | 25:1 $I_2$/Hg treated Crude | Darco + $Na_2S_4$ | 0.1192 | 1248 | 130 | 58.85 |
| 85 | 25:1 $I_2$/Hg treated Crude | DE + $Na_2S_4$ | 0.1045 | 545 | 207 | 82.04 |
| 86 | 25:1 $I_2$/Hg treated Crude | FCC + $Na_2S_4$ | 0.1069 | 1157 | 153 | 61.83 |
| 87 | 25:1 $I_2$/Hg treated Crude | Silica Gel + $Na_2S_4$ | 0.1108 | 773 | 177 | 74.50 |
| 88 | 25:1 $I_2$/Hg treated Crude | $Al_2O_3$ Ext. + $Na_2S_4$ | 0.1135 | 1158 | 143 | 61.79 |

TABLE 10-continued

| Ex. No. | Crude | Adsorbent | Ads. grams | Sol. Hg, Ppb | Calculated Hg on Ads. ppm | % Hg Removed |
|---|---|---|---|---|---|---|
| 89 | 25:1 $I_2$/Hg treated Crude | Darco + $(NH_4)_2S_4$ | 0.1073 | 2099 | 75 | 30.75 |
| 90 | 25:1 $I_2$/Hg treated Crude | DE + $(NH_4)_2S_4$ | 0.1039 | 1245 | 150 | 58.92 |
| 91 | 25:1 $I_2$/Hg treated Crude | FCC + $(NH_4)_2S_4$ | 0.1124 | 803 | 172 | 73.50 |
| 92 | 25:1 $I_2$/Hg treated Crude | Silica Gel + $(NH_4)_2S_4$ | 0.1110 | 1190 | 144 | 60.74 |
| 93 | 25:1 $I_2$/Hg treated Crude | $Al_2O_3$ Ext. + $(NH_4)_2S_4$ | 0.1055 | 144 | 238 | 95.24 |

Most adsorbents were effective in removing 50% of the total mercury from the I2-digested crude. Three adsorbents removed over 90%: Thiosulfate bound polymer, silica gel impregnated with sodium thiosulfate (a thiosulfate-impregnated silica), and the alumina extrudate impregnated with ammonium polysulfide (a polysulfide-impregnated alumina). The mercury content of most adsorbents was 100 ppm or more. Four adsorbents had mercury contents of 200 ppm or more.

It is anticipated that the mercury in the adsorbents that were impregnated with sodium or ammonium polysulfide will be in the form of mercuric sulfide. These will be non-leachable and will pass TCLP requirement.

EXAMPLES 94 TO 108

The simulated crude of example 1 was tested with these treated metal oxides. This simulated crude contained 380 ppbw dissolved elemental mercury and in these examples, it was not treated with iodine. Results are shown in Table 11.

These results show that if elemental mercury remains in the treated crude, these adsorbents are effective in removing it.

EXAMPLES 109 TO 119

A series of zeolites were tested using 25:1 $I_2$/Hg treated crude number 2 containing 8,950 ppm Hg. Rather than filtration, the products were analyzed after settling overnight. Results are shown in Table 12.

The zeolites in examples 109, 111, 113, 115, 117, 118, and 119 were obtained from Zeolyst International.

The zeolite in example 112 was obtained from Sud Chemie.

The zeolite in example 110 was obtained from Toyo Soda Manufacturing Co.

The zeolites in examples 114 and 116 were obtained from Sigma Aldrich.

TABLE 11

| Example | Crude | Adsorbent | Ads. grams | Sol. Hg, ppb | Calculated Hg on Ads. Ppm | % Hg Removed |
|---|---|---|---|---|---|---|
| 94 | Simulated Crude | Darco + Thiosulfate | 0.1095 | 10 | 29 | 97.36 |
| 95 | Simulated Crude | DE + Thiosulfate | 0.1088 | 276 | 8 | 27.33 |
| 96 | Simulated Crude | FCC + Thiosulfate | 0.1020 | 263 | 10 | 30.82 |
| 97 | Simulated Crude | Silica Gel + Thiosulfate | 0.1034 | 215 | 14 | 43.40 |
| 98 | Simulated Crude | $Al_2O_3$ Ext. + Thiosulfate | 0.1096 | 15 | 28 | 96.13 |
| 99 | Simulated Crude | Darco + $Na_2S_4$ | 0.1180 | 7 | 27 | 98.04 |
| 100 | Simulated Crude | DE + $Na_2S_4$ | 0.1048 | 241 | 11 | 36.48 |
| 101 | Simulated Crude | FCC + $Na_2S_4$ | 0.1102 | 128 | 19 | 66.23 |
| 102 | Simulated Crude | Silica Gel + $Na_2S_4$ | 0.1135 | 133 | 18 | 65.00 |
| 103 | Simulated Crude | $Al_2O_3$ Ext. + $Na_2S_4$ | 0.1069 | 168 | 17 | 55.76 |
| 104 | Simulated Crude | Darco + $(NH_4)_2S_4$ | 0.1021 | 6 | 31 | 98.30 |
| 105 | Simulated Crude | DE + $(NH_4)_2S_4$ | 0.1004 | 40 | 29 | 89.38 |
| 106 | Simulated Crude | FCC + $(NH_4)_2S_4$ | 0.1131 | 11 | 28 | 97.14 |
| 107 | Simulated Crude | Silica Gel + $(NH_4)_2S_4$ | 0.1420 | 25 | 21 | 93.48 |
| 108 | Simulated Crude | $Al_2O_3$ Ext. + $(NH_4)_2S_4$ | 0.1000 | 40 | 29 | 89.49 |

TABLE 12

| Example No | Adsorbent | Settled Product Hg, ppb | % Hg Removed by Settling |
|---|---|---|---|
| 109 | CBV 500: Y zeolite | 8,170 | 8 |
| 110 | Y zeolite | 8,130 | 9 |
| 111 | BETA zeolite | 6,617 | 26 |
| 112 | H-Beta Zeolite | 8,390 | 6 |
| 113 | ACID WASHED CBV-600 zeolite | 7,550 | 15 |
| 114 | Cs exchanged X zeolite | 7,503 | 16 |
| 115 | CBV-720 USY zeolite | 8,007 | 10 |
| 116 | 4A zeolite | 8,573 | 4 |
| 117 | ZSM-12 zeolite | 7,653 | 14 |
| 118 | CBV 712: Y Zeolite | 8,360 | 6 |
| 119 | SSZ-32 zeolite | 8,097 | 9 |

It is expected that the performance of these zeolites would be improved by the incorporation of sulfur compounds as described above.

EXAMPLES 120 TO 130

A sample of condensate No. 2 containing 988 ppbwHg was tested as is, and a portion was treated with iodine dissolved in methanol at different $I_2$/Hg ratios. The untreated and iodine-treated condensates were then mixed with the silica gel coated with sodium thiosulfate as described previously. A sample of an untreated silica gel was also tested for comparison. The results are shown below in Table 13.

TABLE 13

| Example No | Adsorbent | Hg/$I_2$ ratio | Settled Product Hg, ppb | % Hg Removed by Settling | 0.45 μm filtered product Hg ppb | % Hg removed by filtering |
|---|---|---|---|---|---|---|
| 120 | None | 0 | 901 | 8.84 | 714 | 27.78 |
| 121 | None | 5.37 | 933 | 5.53 | 802 | 18.88 |
| 122 | Silica Gel + Thiosulfate | 5.37 | 478 | 51.65 | 338 | 65.84 |
| 123 | None | 10.75 | 915 | 7.43 | 869 | 12.02 |
| 124 | Silica Gel | 10.75 | 940 | 4.88 | 840 | 14.95 |
| 125 | Silica Gel + Thiosulfate | 10.75 | 251 | 74.59 | 193 | 80.49 |
| 126 | None | 26.87 | 821 | 16.90 | 859 | 13.02 |
| 127 | Silica Gel | 26.87 | 945 | 4.41 | 887 | 10.18 |
| 128 | Silica Gel + Thiosulfate | 26.87 | 453 | 54.14 | 368 | 62.76 |
| 129 | None | 50.76 | 888 | 10.17 | 811 | 17.93 |
| 130 | Silica Gel + Thiosulfate | 50.76 | 715 | 27.63 | 579 | 41.36 |

This condensate contains very fine Hg particles: approximately 74% of the Hg particles have sizes below 0.45 μm. As expected, little mercury can be removed untreated sample in example 118 by either settling or filtration. When iodine is reacted with this crude and an adsorbent is not used, the situation does not change. Little mercury can be removed by either settling or filtration (Examples 121, 123, 126 and 129). This is consistent with the theory that the iodine dissolves the HgS and converts a portion into an oil soluble species.

On iodine treated samples of this condensate, use of untreated silica gel is not effective in removing mercury by settling or filtration (Examples 124 and 1275).

However, thiosulfate-treated silica gel is shown to be effective in removing mercury by both settling and filtration (Examples 122, 125, 128 and 130). On this feedstock, the optimum $I_2$/Hg ratio appears to be about 10. Each crude responds differently to the $I_2$/Hg ratio and the adsorbent. Also, the optimum can depend on whether the mercury is to be removed by settling or filtration. Some experimentation is required to optimize the treatment for a specific crude or condensate.

EXAMPLES 131 TO 134

In order to evaluate the effect of the dose of adsorbent on the removal of mercury a sample of the North American crude containing 9,247 ppbwHg was treated with iodine in methanol to give a 24.89 $I_2$/Hg product. The iodine-treated crude was then mixed with the silica gel coated with sodium thiosulfate as described above. Results are shown in Table 14.

TABLE 14

| Example No | Adsorbent | Wt % in Crude | Settled Product Hg, ppb | % Hg Removed by Settling | 0.45 μm Filtered Product Hg ppb | % Hg Removed by Filtering |
|---|---|---|---|---|---|---|
| 131 | None | 0 | 8,547 | 7.57 | 8,593 | 7.07 |
| 132 | Silica Gel + Thiosulfate | 0.12 | 6,960 | 24.73 | 6,870 | 25.71 |
| 133 | Silica Gel + Thiosulfate | 0.24 | 5,633 | 39.08 | 5,490 | 40.63 |
| 134 | Silica Gel + Thiosulfate | 1.22 | 1,347 | 85.44 | 1,233 | 86.66 |

On this particular crude, doses as low as 0.12 wt % adsorbent are effective in removing mercury. The percentage removal of mercury increases as the dose increases. Each crude responds differently to the dose of the adsorbent. Also, the optimum can depend on whether the mercury is to be removed by settling or filtration. Some experimentation is required to optimize the treatment for a specific crude or condensate.

EXAMPLES 135 TO 138

In order to demonstrate that this technology works for elemental mercury as well as particulate mercury, the sample of volatile $Hg^0$ in simulated crude from example 1 was tested as is and after treatment with $I_2$ in methanol at a stoichiometric ratio of 25:1. Some elemental mercury had been lost during storage and at the start of these experiments, and the mercury content of the feed was 376 ppbw. The adsorbents were prepared as described previously. Results are shown in Table 15.

TABLE 15

| Example | Feed | Adsorbent | Filtered Product Hg, ppb | % Hg Removed by Filtering |
|---|---|---|---|---|
| 135 | Sim. Crude, Example 1 | Silica Gel + Thiosulfate | 246 | 34.61 |
| 136 | Sim. Crude, Example 1 | $Al_2O_3$ Ext. + $(NH_4)_2S_4$ | 20 | 94.76 |
| 137 | Sim. Crude, 25:1 $I_2$/Hg | Silica Gel + Thiosulfate | 3 | 99.30 |
| 138 | Sim. Crude, 25:1 $I_2$/Hg | $Al_2O_3$ Ext. + $(NH_4)_2S_4$ | 14 | 96.36 |

Only the $Al_2O_3$ Ext.+$(NH_4)_2S_4$ is highly effective in removing elemental mercury, but both adsorbents are highly effective in removing the reaction product of elemental mercury and the halogen. Thus this technology is effective in removing both elemental mercury and particulate mercury sulfide from crudes and condensates.

EXAMPLES 139 TO 149

A series of metal organic framework materials were prepared and activated under conditions listed in Table 14. A100 (example 151), C300 (examples 139, 142 and 143), F300 (examples 152 and 153), and Z1200 MOFs (examples 149 and 150), were purchased from Sigma-Aldrich. These were used as such or modified as described below and summarized in Table 16.

Nano-HKUST-1 (example 140) was synthesized according to Tranchemontagne, David J., et, al.; Tetrahedron, 2008, volume 64, pages 8553-8557, incorporated by reference.

M-bpe, where M=Ni, (examples 152 and 145), were synthesized according to Maji, Tapas K., et. al.; Nat. Mater., 2007, volume 6, pages 142-148, incorporated by reference.

M-bpe, where M=Co, (example 147), was synthesized according to Haldar, Ritesh, et. al.; Cryst. Eng. Comm., 2012, 14, 684-690, incorporated by reference.

In-rho-ZMOF (example 154), was synthesized according to Ananthoji, Ramakanth, et. al.; J. Mater. Chem., 2011, 21, 9587-9594, incorporated by reference.

Post synthesis modifications by thiol addition were done using procedures described in Ke, Fei, et. al.; J. Hazard. Mater., 2011, 196, 36-43, incorporated by reference (examples 141, 142, 143, 146, 148, 153, 154, 156, 157, and 159). This created new materials.

Post synthesis modifications by alkylation were done using procedures described in Vilaca, Gil, et. al.; Adv. Mater., 2006, 18, 1073-1077, incorporated by reference (examples 142, 150, 158, and 160). This created new materials.

Fumed silica was obtained from Cabot Corporation.

Beta zeolite (examples 159, 160) and CBV 500 Y zeolite (examples 157, 158) were obtained from Zeolyst International.

TABLE 16

| Ex. No, | Material | metal | pore dimensionality | feature | activation T ('C.) | activation atmosphere |
|---|---|---|---|---|---|---|
| 139 | HKUST-1 | Cu | 3 | UMC* | 175 | vac |
| 140 | nano HKUST-1 | Cu | 3 | nano | 175 | vac |
| 141 | Nano HKUST-1-SH | Cu | 3 | nano/fn** | RT | vac |
| 142 | C300-M-SH | Cu | 3 | fn | RT | vac |
| 143 | C300-SH | Cu | 3 | fn | RT | vac |
| 144 | Ni-bpe-as syn | Ni | 3 (interpen) | labile/flex+ | RT | ambient |
| 145 | Ni-bpe-95 | Ni | 3 (interpen) | labile/flex | 85 (95) | vac |
| 146 | Ni-bpe SH | Ni | unconfirmed | labile/fn/flex | RT | vac |
| 147 | Co-bpe | Co | 3 (interpen) | labile/flex | 85 | vac |
| 148 | Co-bpe-SH | Co | unconfirmed | labile/fn/flex | RT | vac |
| 149 | ZIF-8 | Zn | 3 | zeo-like | 110 | vac |
| 150 | Z1200-M | Zn | 3 | zeo/hydrophob | 110 | vac |
| 151 | MIL-53 | Al | 1 | flex | 175 | vac |
| 152 | Fe-BTC | Fe | N/A | polymer | 110 | vac |
| 153 | Fe-BTC-SH | Fe | N/A | polymer fn | RT | vac |
| 154 | In-rho-ZMOF | In | 3 (charged) | anionic | 175 | vac |
| 155 | fumed alumina-SH | Al | N/A | high metal/fn | RT | vac |
| 156 | fumed silica-SH | Si | N/A | high metal/fn | RT | vac |
| 157 | CBV-500-Y-SH | Si/Al | 3 | zeo fn | RT | vac |
| 158 | CBV-500-Y-M | Si/Al | 3 | zeo fn | 110 | vac |

TABLE 16-continued

| Ex. No, | Material | metal | pore dimensionality | feature | activation T (°C.) | activation atmosphere |
|---|---|---|---|---|---|---|
| 159 | Zeolyst-BEA-SH | Si/Al | 3 | zeo fn | 110 | vac |
| 160 | Zeolyst-BEA-M | Si/Al | 3 | zeo fn | 110 | vac |

*UMC—unsaturated metal center
**fn—functionalized
+flex—flexible framework
SH—thiol addition
M—alkylation

EXAMPLES 161 TO 171

The adsorbents prepared in examples 139 to 160 were tested with a crude containing 9,057 ppbwHg and treated with $I_2$ in MeOH at a 26.87 $I_2$/Hg molar ratio. Rather than filtration, the products were analyzed after settling overnight and filtration. Results are shown in Table 17.

TABLE 17

| Example No | Adsorbent Prep. Example # | Adsorbent | Settled Product Hg, ppb | % Hg Removed by settling | Filtered Product Hg, ppb | % Hg Removed By Filter |
|---|---|---|---|---|---|---|
| 161 | 139 | C300, Cu-HKUST-1 | 9,227 | −1.88 | 8,773 | 3.13 |
| 162 | 140 | 4786_11B nano HKUST-1 | 9,000 | 0.63 | 8,390 | 7.36 |
| 163 | 142 | 4786-17A C300 M-SH | 8,743 | 3.46 | 8,073 | 10.86 |
| 164 | 144 | 4786-13AB, Ni-bpe-as-syn | 8,567 | 5.41 | 7,110 | 21.49 |
| 165 | 145 | 4786-13C 2xconc | 6,483 | 28.41 | 3,123 | 65.51 |
| 166 | 146 | C4786_17B Ni-bpe-SH | 4,813 | 46.85 | 3,990 | 55.94 |
| 167 | 149 | Z1200-Zn-ZIF-8 | 8,633 | 4.67 | 8,690 | 4.05 |
| 168 | 150 | 4786-15 Z1200M | 8,830 | 2.50 | 8,027 | 11.37 |
| 169 | 151 | A100 AI-MIL-53 | 8,613 | 4.90 | 8,033 | 11.30 |
| 170 | 152 | F300, Fe-BTC | 8,170 | 9.79 | 8,217 | 9.27 |
| 171 | 154 | 4786-12 In-rho-ZMOF | 9,127 | −0.77 | 8,560 | 5.48 |
| 172 | 143 | C300-SH | 8,413 | 9.02 | 7,647 | 17.31 |
| 173 | 153 | F300-SH | 8,810 | 4.73 | 8,360 | 9.59 |
| 174 | 155 | Alumina-SH | 9,237 | 0.11 | 8,203 | 11.29 |
| 175 | 147 | Co-bpe | 8,950 | 3.21 | 8,180 | 11.54 |
| 176 | 156 | Silica-SH | 8,967 | 3.03 | 8,153 | 11.83 |
| 177 | 158 | CBV-500-Y-M | 9,120 | 1.37 | 8,207 | 11.25 |
| 178 | 159 | Zeolyst-BEA-SH | 8,907 | 3.68 | 7,807 | 15.58 |
| 179 | 141 | nano HKUST-1-SH | 4,250 | 54.04 | 2,397 | 74.08 |
| 180 | 160 | Zeolyst-BEA-M | 8,497 | 8.11 | 7,480 | 19.11 |
| 181 | 148 | Co-bpe-SH | 7,320 | 20.84 | 6,140 | 33.60 |
| 182 | 157 | CBV-500-Y-SH | 9,047 | 2.17 | 8,457 | 8.55 |
| 183 | None | No adsorbent - Control | 9,170 | −1.25 | 8,527 | 5.85 |

The thiol-modified MOFs showed the greatest uptakes (examples 165, 166, 179 and 181). These are examples of Sulfur-treated MOFs. The HKUST-1 series contains unsaturated metal centers and these improve in performance when they are thiol-modified (example 179). The nano HKUST sample (example 179) also showed the best performance indicating that small crystal size enhances performance.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

What is claimed is:

1. A non-aqueous process to remove mercury from a crude, the process comprising:

mixing the crude containing particulate mercury with a halogen to form a digested crude to covert at least 10% of the particulate mercury into an oil-soluble mercury complex in the oil phase, contacting the digested crude with an adsorbent to remove at least 50% of the total mercury from the digested crude.

2. The process of claim 1, wherein the oil-soluble mercury complex comprises $HgI_2$.

3. The process of claim 1, wherein the digested crude contains less than 2% total water as measured by Karl Fischer method.

4. The process of claim 1, wherein the halogen is selected from the group consisting of bromine, iodine and combinations thereof.

5. The process of claim 1, wherein the halogen is in the form of an organic solution.

6. The process of claim 1, wherein the mixing and the contacting are under conditions to maintain the crude essentially in the liquid state.

7. The process of claim 6, wherein the conditions comprise temperature and pressure for the crude to be below its bubble point.

8. The process of claim 1, wherein the halogen comprises iodine and bromine, and wherein the iodine and bromine are present at a $I_2$:$Br_2$ molar ratio of greater than or equal to 0.1 and less than or equal to 1000.

9. The process of claim 8, wherein the $I_2$:$Br_2$ molar ratio is greater than or equal to 5 and less than or equal to 100.

10. The process of claim 8, wherein the $I_2$:$Br_2$ molar ratio is greater than or equal to 10 and less than or equal to 50.

11. The process of claim 1, wherein the adsorbent is selected from the group consisting of sulfur-containing polymers, anion exchange resins, molecular sieves, zeolites, metal organic framework (MOF) materials, metal oxides treated with sulfur compounds, carbon treated with sulfur compounds, clays, synthetic layered materials, sulfur-treated MOFs, self-assembled monolayers on mesoporous supports, selenium modified adsorbents, and combinations thereof.

12. The process of claim 1, wherein the adsorbent is a sulfur-treated metal oxides and carbon treated with sulfur compounds and the sulfur compounds are selected from the group consisting of thiosulfates, polysulfides and combinations thereof.

13. The process of claim 1, wherein the adsorbent is selected from the group consisting of thiosulfate-impregnated silica, polysulfide impregnated alumina, and combinations thereof.

14. The process of claim 1, wherein the adsorbent is essentially non-leachable.

15. The process of claim 1, wherein the contacting the digested crude with the adsorbent is in a process selected from the group consisting of a fixed bed, a fluidized bed, an ebullated bed, and expanded bed, and combinations thereof.

16. The process of claim 1, wherein the adsorbent is in the form of a powder and the powder is separated from the digested crude by processes selected from the group consisting of settling, filtration, centrifugation, hydrocyclones and combinations thereof.

17. The process of claim 1, wherein the crude is a fine-particulate high-mercury crude or condensate.

18. The process of claim 1, wherein the crude is predominantly non-volatile.

19. The process of claim 1, wherein the crude has a particulate mercury content of 10% or more.

20. The process of claim 1, further comprising recovery of the adsorbent and wherein the adsorbent to be recovered has a total mercury content of 100 ppm or more.

21. The process of claim 20, wherein the halogen is iodine and wherein at least a portion of the iodine and iodide that is adsorbed on the recovered adsorbent is recycled and mixed with a crude to form a digested crude.

* * * * *